United States Patent [19]

Pocock

[11] Patent Number: 4,492,559

[45] Date of Patent: Jan. 8, 1985

[54] SYSTEM FOR CONTROLLING COMBUSTIBLES AND $O_2$ IN THE FLUE GAS FROM COMBUSTION PROCESSES

[75] Inventor: Robert E. Pocock, Highland Heights, Ohio

[73] Assignee: The Babcock & Wilcox Company, New Orleans, La.

[21] Appl. No.: 551,550

[22] Filed: Nov. 14, 1983

[51] Int. Cl.[3] ..... F23N 5/00

[52] U.S. Cl. ..... 431/12; 431/76

[58] Field of Search ..... 431/76, 12; 236/15 E

[56] References Cited

U.S. PATENT DOCUMENTS

| | | | |
|---|---|---|---|
| 4,147,500 | 4/1979 | Karlsoen | 431/76 |
| 4,162,889 | 7/1979 | Shigemura | 431/12 |
| 4,235,171 | 11/1980 | Leonard | 236/15 E |
| 4,360,336 | 11/1982 | Shepherd | 431/12 |
| 4,362,499 | 12/1982 | Nethery | 431/12 |
| 4,436,506 | 3/1984 | Berkhof | 431/76 |

*Primary Examiner*—Carroll B. Dority, Jr.

*Attorney, Agent, or Firm*—Vytas R. Matas; Robert J. Edwards

[57] ABSTRACT

A control system for controlling the fuel/air ratio of a fuel/air mixture for a combustion process which produces flue gases having a combustible content and an oxygen content, comprises selecting desired combustible and oxygen contents for the flue gases which correspond to efficient combustion, simultaneously sensing both actual combustion and actual oxygen content in the flue gases, and controlling the fuel/air ratio in accordance only with the sensed combustible and oxygen content to adjust the ratio until the selected set points are reached. The combustible content can be utilized to regulate the oxygen content set point.

6 Claims, 1 Drawing Figure

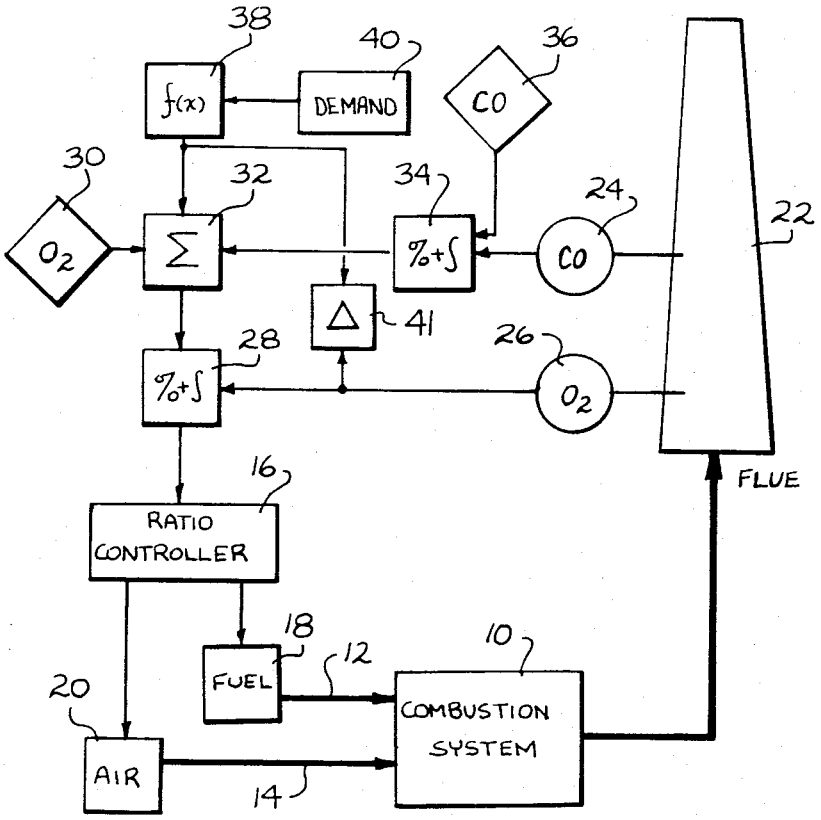
38
40
36
f(x)
DEMAND
CO
30
32
34
24
22
O2
Σ
%+∫
CO
Δ
41
28
26
%+∫
O2
FLUE
16
RATIO CONTROLLER
18
12
10
FUEL
COMBUSTION SYSTEM
20
AIR
14

SYSTEM FOR CONTROLLING COMBUSTIBLES AND $O_2$ IN THE FLUE GASES FROM COMBUSTION PROCESSES

FIELD AND BACKGROUND OF THE INVENTION

The present invention relates in general to combustion processes and, in particular, to a new and useful system for controlling combustibles; in particular, carbon monoxide, and oxygen in the flue gases of a combustion process which is supplied with a fuel/air mixture.

A number of methods are known for controlling combustion efficiency by analyzing the composition of flue gases generated by a combusion process.

It is known to control, or trim, the fuel/air ratio using an oxygen control loop or a carbon monoxide control loop.

Control of combustion efficiency using an oxygen control loop has shortcomings in that a zirconium oxide oxygen sensor cannot determine if the fuel and air are burned. The actual fuel/air ratio is being measured and this is a measurement of efficiency only if complete combustion takes place (which is normally not the case).

If carbon monoxide, or other combustible, is sensed for the purpose of controlling the combustion process, the fuel/air ratio is not determined nor is the actual efficiency of the burning. Combustible sensing merely tells the amount of unburned fuel left over from combustion. A control using a carbon monoxide or combustible measurement alone cannot tell whether more air improves combustion or just dilutes the the flue gases to lower the carbon monoxide content of the flue gases. The increased amount of air required, if combustion is improved, is extremely small but a large amount is required to dilute the carbon monoxide back to set point when combustion does not improve with added air. Thus, an increasingly inefficient combustion may be taking place even when reduced amount of carbon monoxide are sensed in the flue gases.

U.S. Pat. No. 4,231,733 to Hickman, et al, shows a method of measuring oxygen and combustibles for use in adjusting a fuel/air ratio control. This method has the same shortcomings as the oxygen control described above. It also has a further shortcoming in that is cannot measure oxygen and combustibles at the same time. The Hickman, et al, patent discloses a scheme for switching from oxygen sensing to combustible sensing at a selected point. In fact, both oxygen and combustibles are almost always found together when a combustion process is operated at its most efficient combustion point. Only in a very few cases, where combustion is carried out under pressures higher than 50 psig is it possible to have extremely low excess oxygen with no combustibles.

U.S. Pat. No. 4,162,889 to Shigemura discloses a method and apparatus for controlling combustion efficiency where oxygen and combustibles are sensed in a flue gas. A flow measurement and a quality of fuel measurement must also be utilized to achieve the control function, however.

U.S. Pat. No. 4,330,260 to Jorgensen, et al, discloses a method and apparatus for regulating combustion in a furnace which utilizes an oxygen sensor as well as an optional carbon dioxide sensor for achieving a conrol function. The speed of a blower is regulated according to this patent to effect optimum combustion efficiency. The sensing of a combustible content, and in particular the amount of carbon monoxide left in the flue gases, is not disclosed.

SUMMARY OF THE INVENTION

A main object of the present invention is to provide a control system, including an apparatus and a method, for controlling the fuel/air ratio of a fuel/air mixture supplied to a combustion system which in turn produces an flue gas having a combustible content and an oxygen content. Both the combustible, usually in the form of carbon monoxide, and the oxygen content for the flue gases are measured and utilized to control the ratio.

According to one advantageous feature of the invention, a low set point is selected for combustible content and is utilized to adjust an initially selected oxygen content set point. The oxygen content set point is used in conjunction with a controller to control the ratio.

Alternately, the combustible and oxygen sensors can be utilized through their individual controllers to influence the ratio control for the flue/air mixture.

Accordingly, a further object of the invention is to provide a method of controlling a fuel/air ratio of a fuel/air mixture for a combustion process which produces flue gases having a combustible content and an oxygen content, comprising:

Selecting a low combustion content set point value corresponding to a desired level of combustible content in the flue gas;

Selecting an oxygen content set point value corresponding to a desired level of oxygen content in the flue gas;

Sensing the combustible content of the flue gas to generate a first signal corresponding to the actual combustible content of the flue gas;

Simultaneously, sensing the oxygen content of the flue gas to generate a second signal corresponding to the actual oxygen content of the flue gas;

Controlling the flue/air ratio exclusively as a function of said first and second signals.

Another object of the invention is to provide such a method wherein the oxygen set point is controlled by the first signal corresponding to actual combustible content in the flue gas to increase efficiency.

Another object of the invention is to provide an apparatus for controlling a fuel/air ratio of a fuel/air mixture provided to a combustion system which produces a flue gas by simultaneously sensing a combustible, in particular carbon monoxide, content in the flue gas as well as oxygen content in the flue gas and regulating the fuel/air ratio utilizing a ratio controller which is responsive only to the combustible and oxygen content signals from the sensors.

A further object of the invention is to provide a method and apparatus for controlling a fuel/air ratio of a fuel/air mixture supplied to a combustion system and process which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWING

The only FIGURE presented is a block diagram of one embodiment of the invention.

DESCRIPTION OF THE PREFERRED EMBODIMENT

Referring to the drawing in particular, the invention embodied therein comprises a system for controlling the fuel/air ratio of fuel and air supplied to a combustion system 10 over lines 12 and 14. Ratio control means 16 are connected to a fuel controller 18 and an air controller 20. Fuel controller 18 is connected to line 12 for controlling the amount of fuel supplied to combustion system 10 and air controller 20 is connected to line 14 for controlling the amount of air supplied to combustion system 10. Either one or both of the air and fuel may be controlled by controller 16 or any other scheme may be provided for regulating the fuel/air ratio of the fuel/air mixture supplied to the combustion system.

As a result of combustion, exhaust gases are produced which are available at a flue 22.

According to the invention, a combustible content sensor 24, in the form of a carbon monoxide sensor, is associated with flue 22 for sensing the content of carbon monoxide in the flue gases. An oxygen content sensor 26 is also provided and associated with flue 22 for entering the oxygen content of the flue gases.

Each of the sensors 24, 26 can influence the selection of an appropriate fuel/air ratio by controller 16.

According to the specific embodiment illustrated, oxygen sensor 26 is connected to an oxygen controller 28 which controls the ratio controller 16 to adjust the ratio by sensing the difference between an oxygen content set point supplied by unit 30 and the actual content supplied by sensor 26. Unit 30 may embody a method to change $0_2$ setpoint based upon the total BTU input to the combustion system 10.

The value of the oxygen setpoint 30 is available over a summer 32, to the oxygen controller 28. The ratio controller 16 is regulated until the actual oxygen content meets the desired or selected oxygen content set in unit 30. The oxygen content of unit 30 is selected for maximum combustion efficiency.

According to the invention, since the amount of combustibles remaining in the flue gases is also a measure of efficiency, the combustible or carbon monoxide sensor 24 is connected through combustible controller 34 to summer 32 to modify or regulate the oxygen content setpoint signal of unit 30. In effect a modified setpoint signal is provided to controller 28 which is responsive to the influence of sensor 24. A desired low combustible content is set by unit 36, to correspond to a desired low combustible, and, in particular, a carbon monoxide content for the flue gases, which also corresponds to a particularly efficient combustion.

Thus, according to the invention, both oxygen and combustible content is measured simultaneously and continuously and utilized to influence the selection of a fuel/air ratio which produces combustion of desired efficiency.

In known fashion the ratio controller 16 operates through a process load index unit 38 which itself is regulated by a BTU demand signal from unit 40. Unit 38 output can be made to equal the most efficient burning possible at each BTU input to combustion system 10, while still holding a low C0 setpoint. Unit 41 alarm compares the output of unit 38 with the actual oxygen sensed in the flue 22 and initiates an alarm signal when the difference is more than desired.

While specific embodiments of the invention have been shown and described in detail to illustrate the application of the principles of the invention, it will be understood that the invention may be embodied otherwise without departing from such principles.

What is claimed is:

1. A method of controlling a fuel/air ratio of a fuel/air mixture for a combustion process which produces flue gases having a combustible content and an oxygen content, comprising;

selecting a low combustion content set point value corresponding to a desired level of combustible content in the flue gas;

selecting an oxygen content set point value corresponding to a desired level of oxygen content in the flue gas;

sensing the combustible content of the flue gas to generate a first signal corresponding to the actual combustible content of the flue gas;

simultaneously, sensing the oxygen content of the flue gas to generate a second signal corresponding to the actual oxygen content of the flue gas;

using said first signal corresponding to an actual combustible content of the flue gas to adjust said selected oxygen content set point value; and controlling the fuel/air ratio exclusively as a function of said adjusted oxygen content set point value and said second signal.

2. A method according to claim 1 wherein said selected low combustible content set point and said selected oxygen content set point are selected to correspond to actual combustion and oxygen content for the flue gas indicative of maximum efficiency for the combustion process.

3. A method according to claim 2 wherein said first signal corresponding to an actual combustible content of the flue gas is used to adjust said selected oxygen content set point.

4. An apparatus for controlling a fuel/air ratio of a fuel/air mixture for a combustible system having a flue for receiving flue gas as a product of a combustion process in the combustion system, the flue gas having a combustible content and an oxygen content, comprising;

a combustible content sensor associated with the flue for sensing the combustible content in the flue gas;

an oxygen content sensor associated with the flue for sensing oxygen content of flue gas in the flue;

fuel/air ratio control means connected to the combustion system for controlling the ratio of fuel and air in a fuel/air mixture supplied to the combustion process;

an oxygen set point station for establishing an oxygen level set point signal;

means to provide a combustible content set point signal;

a combustible controller connected between said combustible content sensor and said ratio control means and adapted to receive a combustible content set point signal and providing an output signal therefrom;

means for establishing a modified oxygen level set point as a function of the output of said combustible controller and said oxygen level set point signal; and an oxygen controller connected between said oxygen content sensor and said ratio control means and adapted to receive an oxygen content set point from said establishing means for influencing said ratio control means to regulate the fuel/air mixture.

5. An Apparatus according to claim 4, including a control loop containing said oxygen control and demand means for adjusting said ratio control means to a selected demand, said combustible controller connected to said control loop for regulating the oxygen content setpoint signal.

6. An apparatus according to claim 5, including comparator means for comparing the output of said demand means with the actual $0_2$ signal, said comparator means initiating an alarm when the deviation between the output of said demand means and said actual $0_2$ signal is more than a desired difference.

* * * * *